US006539183B2

(12) United States Patent
Ishimizu et al.

(10) Patent No.: US 6,539,183 B2
(45) Date of Patent: Mar. 25, 2003

(54) IMAGE FORMING APPARATUS FOR NORMAL AND THICK PRINT MEDIA

(75) Inventors: Hideaki Ishimizu, Tokyo (JP); Noboru Ooishi, Tokyo (JP); Takao Uchida, Tokyo (JP); Takao Mizutani, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/977,498

(22) Filed: Oct. 16, 2001

(65) Prior Publication Data

US 2002/0076226 A1 Jun. 20, 2002

(30) Foreign Application Priority Data

Oct. 18, 2000 (JP) ..... 2000-317927

(51) Int. Cl.[7] ..... G03G 15/08; G03G 15/01
(52) U.S. Cl. ..... 399/45; 399/53; 399/236
(58) Field of Search ..... 399/45, 68, 75, 399/236, 53, 279, 254, 127

(56) References Cited

FOREIGN PATENT DOCUMENTS

JP 7-64361 A * 3/1995
JP 9-258548 A * 10/1997
JP 10-63090 A * 3/1998

* cited by examiner

*Primary Examiner*—Joan Pendegrass
(74) *Attorney, Agent, or Firm*—Rabin & Berdo, P.C.

(57) ABSTRACT

An image-forming apparatus includes a developing roller and a developing blade. The developing blade applies toner to the developing roller to form a thin layer of toner on the developing roller. The image-forming apparatus performs a printing operation that includes a paper-feeding period and a developing period following the paper-feeding period. The developing roller rotates relative to the developing blade at a first speed during the paper-feeding period and then at a lower second speed than during the developing period, thereby eliminating chance of white lines of occurring in a printed image. The developing roller may be rotated at a constant speed in each printing operation until the circumferential surface of the developing roller has traveled over a certain cumulative distance. When the surface has traveled over the first distance, the developing roller may be rotated at an increased speed over a certain distance.

20 Claims, 7 Drawing Sheets

IMAGE FORMING APPARATUS FOR NORMAL AND THICK PRINT MEDIA

FIELD OF THE INVENTION

The present invention relates to an image forming apparatus that employs an electrophotography.

DESCRIPTION OF THE RELATED ART

A conventional electrophotographic image-forming apparatus includes a photoconductive drum. Disposed around the photoconductive drum are a charging section, an exposing section, a developing section, a transferring section and a cleaning section. The aforementioned structural elements are housed in a cartridge case.

The developing section includes primarily a developing roller and a developing blade. The developing blade extends in a direction parallel to the developing roller such that one of the long sides of the blade is in contact with the developing roller. The developing blade presses the toner against the circumferential surface of the developing roller so as to form a thin layer of toner on the developing roller. Then, the toner on the developing roller is brought into contact with the surface of the photoconductive drum as the developing roller rotates, so that the toner migrates from the developing roller to an electrostatic latent image formed on the drum. In this manner, the electrostatic latent image is developed into a toner image.

The image forming apparatus operates in two modes: a normal mode where an image is printed on ordinary paper and a thick paper/OHP mode where an image is printed on thick paper or a transparency that requires a longer fixing time than ordinary paper. Thus, the respective rollers are rotated at lower speeds in the thick paper/OHP mode than in the normal mode. In the normal mode, the printing speed is such that 12 pages of A4 size paper can be printed in a minute. In the thick paper/OHP mode, the printing speed is such that 5 pages of A4 size paper can be printed in a minute.

Thus, the rollers rotate at lower speeds in the thick paper/OHP mode than in the normal mode. Rotation at such low speeds can cause toner to be clumped between the developing blade and the developing roller. Toner clumping prevents a uniform layer of fresh toner from being formed on the developing roller, creating surface areas of the developing roller that has not a sufficient amount of toner deposited. This implies that portions of the electrostatic latent image corresponding to such areas are not properly developed into a toner image. As a result, the printed image has areas referred to as "white lines" in which no toner is deposited.

SUMMARY OF THE INVENTION

The present invention was made in view of the aforementioned

An image-forming apparatus includes a developing roller and a developing blade. The developing roller rotates in contact with a photoconductive drum to deposit toner to an electrostatic latent image formed on the photoconductive drum. The developing blade applies toner to the developing roller to form a thin layer of toner on the developing roller. The image-forming apparatus performs a printing operation that includes a paper-feeding period (first period) and a developing period (second period) following the paper-feeding period. The developing roller rotates relative to the toner-applying member at a first circumferential speed during the paper-feeding period, and then rotates at a second circumferential speed during the developing period, the second speed being lower than the first circumferential speed.

The paper-feeding period is a length of time during which a print medium is fed from a medium-holding cassette to a predetermined position in the image-forming apparatus.

The developing roller rotates at a circumferential speed between 73 mm/s and 1015 mm/s.

The developing roller may be rotated at a first circumferential speed until a circumferential surface of the developing roller as traveled over a first circumferential distance with respect to the developing blade. Then, the developing roller may be rotated relative to the developing blade at a second circumferential speed over a second circumferential distance when the surface has traveled over the first circumferential distance, the second circumferential speed being higher than the first circumferential speed. The second distance is longer than half a nip formed between said developing roller and developing blade.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DESCRIPTION OF PREFERRED EMBODIMENTS

Embodiments of the present invention will be described in detail with reference to the accompanying drawings.

First Embodiment

Figure 1:
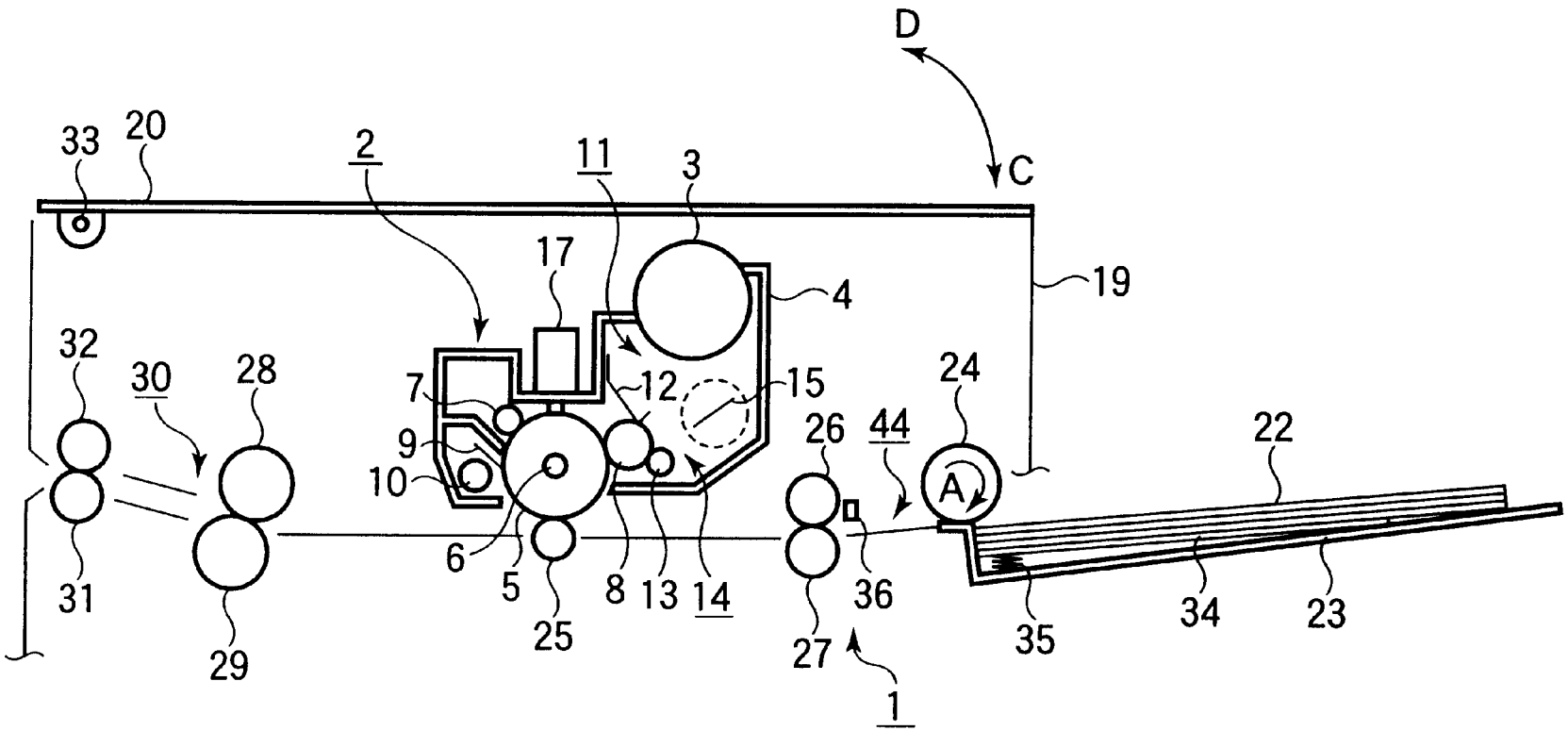
FIG. 1 illustrates a general configuration of an image-forming apparatus according to an embodiment of the invention.

FIG. 1 illustrates a general configuration of an image-forming apparatus according to a first embodiment of the invention.

Figure 2:
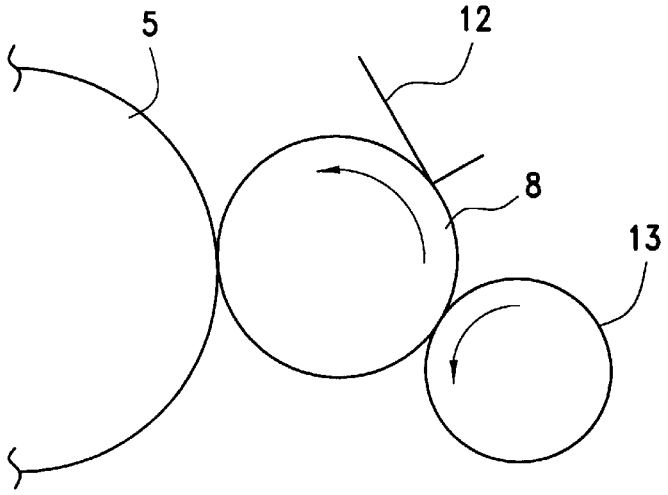
FIG. 2 illustrates a pertinent portion of a developing section according to the embodiment.

FIG. 2 illustrates a pertinent portion of a developing section according to the embodiment.

An image-forming apparatus according to the invention employs electrophotography that is applied to, for example, printers, copying machines, and facsimile machines. In this embodiment, the image-forming apparatus takes the form of a printer.

Referring to FIG. 1, an image-forming apparatus 1 has an image-forming cartridge 2 and a toner cartridge 3, which are detachably mounted to the image-forming apparatus 1. The image-forming cartridge 2 is accommodated in a cartridge case 4. The cartridge case 4 also houses a photoconductive drum 5 that functions as an image-bearing body.

Disposed around the photoconductive drum 5 are a charging roller 7 that charges the surface of the photoconductive drum 5, a developing roller 8, and a cleaning blade 9 that removes residual toner from the surface of the photoconductive drum 5 after a toner image is transferred onto print paper. The charging roller 7, developing roller 8, sponge roller 13, and agitator 15 are all rotatably supported in the cartridge case 4. A spiral screw 10 transports the residual toner removed by the cleaning blade 9 to a waste toner box, not shown.

The developing roller 8 is in a developing section 11. Referring to FIGS. 1 and 2, the developing roller 8 is formed of a sponge-type rubber material. A developing blade 12 and a sponge roller 13 are disposed around the developing roller 8 in pressure contact with the developing roller 8, creating a nip between the developing roller 8 and the developing blade 12. A toner chamber 14 is defined around the developing blade 12 and sponge roller 13. The developing blade 12 forms a toner layer of a uniform thickness on the surface of the developing roller 8. The toner chamber 14 also incorporates a toner agitator 15 and a toner cartridge 3 disposed over the agitator 15. When the toner cartridge 3 becomes exhausted, the toner cartridge 3 is replaced.

The functions of the developing section 11 will now be described.

The toner of non-magnetic single composition is held in the toner chamber 14 and supplied to the developing roller 8 through the sponge roller 13. As the developing roller 8 rotates, the toner on the developing roller 8 is brought into contact with the developing blade 12. Then, the developing blade 12 forms a thin layer of the toner on the surface of the developing roller 8. The thin layer of toner will be brought into contact with the photoconductive drum 5 as the developing roller 8 rotates. In this manner, the electrostatic latent image formed on the photoconductive drum 5 is developed into a toner image.

When a thin layer of toner is formed on the developing roller 8, the toner is subjected to friction between the developing roller 8 and developing blade 12 so that the toner is triboelectrically charged. In the present invention, the toner is negatively charged.

An LED head will now be described. The LED head is disposed between the charging roller 7 and the developing roller 8 and opposes the surface of the photoconductive drum 5. The LED head 7 includes primarily LED arrays each of which has a plurality of LED elements formed therein, not shown, a print circuit board, not shown, on which driver ICs are mounted for driving the LED arrays, and a rod lens array, not shown, that focuses the light emitted from the LED elements. The respective LED elements are energized in accordance with print data or image data received from an external device, thereby forming an electrostatic latent image on the charged surface of the photoconductive drum 5. The developing roller 8 deposits toner on the electrostatic latent image, thereby developing the electrostatic latent image into a toner image.

A transfer roller 25 rotates in pressure contact with the photoconductive drum 5 and transfers the toner image from the surface of the photoconductive drum 5 to the print paper. A fixing section 30 is disposed downstream of the transfer roller 25. The fixing section 30 includes a heat roller 28 that supplies heat to the toner image on the paper and a pressure roller 29 that presses the print paper against the heat roller 28.

The image-forming apparatus 1 includes a paper cassette 23 and a hopper stage 34 on the bottom of the paper cassette 23. A stack of paper 22 is placed on the hopper stage 34. The hopper stage 34 is upwardly urged by a spring 35 so that the leading end portion of the top page of the stack of paper 22 is in pressure contact with a feed roller 24. When the feed roller 24 rotates in a direction shown by arrow A, the top page of the stack of paper 22 is advanced into the image-forming apparatus 1.

The paper 22 is transported to registry rollers 26 and 27 which in turn cause the paper 22 to further advance to a transfer point defined between the photoconductive drum 5 and the transfer roller 25. The paper 22 is advanced in timed relation with the rotation of the photoconductive drum 5 so that the toner image is properly transferred onto the paper 22. After the transfer of a toner image, the paper is further advanced to the fixing unit where the toner image is fused into a permanent image. The paper 22 having a permanent image thereon is discharged from the image-forming apparatus 1. A medium detecting sensor 36 is disposed immediately upstream of the registry rollers 26 and 27.

A lid 20 adapted to be opened and closed is provided on the top of the image-forming apparatus 1. The lid 20 is rotatably mounted to a frame 19 of the image-forming apparatus 1 so that the lid 20 is rotatable in directions shown by arrows C and D. When the lid 20 is opened, the image-forming cartridge 2 can be attached to and detached from the image-forming apparatus 1.

The photoconductive drum 5 will now be described. The photoconductive drum 5 is an electrically conductive cylinder of, for example, aluminum alloy with a charge-developing layer and a charge-transporting layer formed thereon. The photoconductive drum 5 has a drum shaft 6 formed of a metal on which the photoconductive drum 5 rotates. The drum shaft 6 is rotatably supported at longitudinal ends thereof by bearings, not shown, provided on the walls of the cartridge case 4.

The control system that controls the image-forming apparatus 1 of the aforementioned configuration will be described. The description is given only of a portion related to the rotations of the respective rollers.

Figure 3:
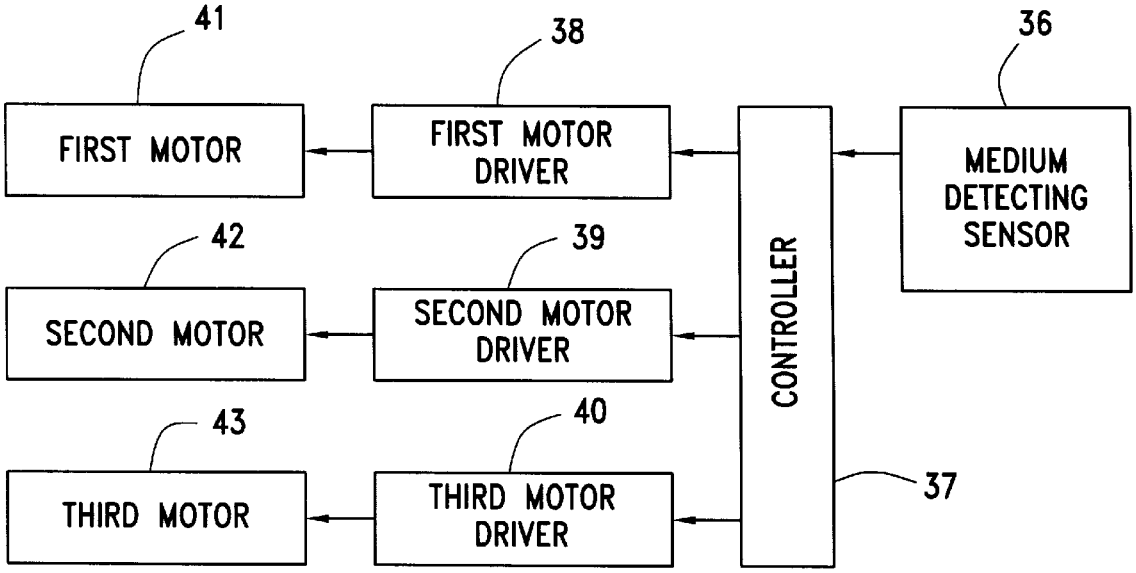
FIG. 3 is a block diagram illustrating the control system for the image-forming apparatus.

FIG. 3 is a block diagram illustrating the control system for the image-forming apparatus.

Referring to FIG. 3, the image-forming apparatus 1 includes a controller 37 that controls the entire image-forming apparatus 1. The controller 37 is connected to the medium-detecting sensor 36, a first motor driver 38, a second motor driver 39, and a third motor driver 40. When the medium-detecting sensor 36 detects the paper 22, the medium-detecting sensor 36 provides a detection signal to the controller 37. The first motor driver 38 drives a first motor 41 that drives the feed roller 24 in rotation. The second motor driver 39 drives a second motor 42 which in turn rotates the photoconductive drum 5, charging roller 7, developing roller 8, spiral screw 10, sponge roller 13, heat roller 28, pressure roller 29, and discharge rollers 31 and 32. The third motor driver 40 drives a third motor 43, which in turn drives the registry rollers 26 and 27 in rotation.

{Printing Operation}

The printing operation of the image-forming apparatus 1 of the aforementioned configuration will be described with reference to FIGS. 1, 3, and 4.

Figure 4:
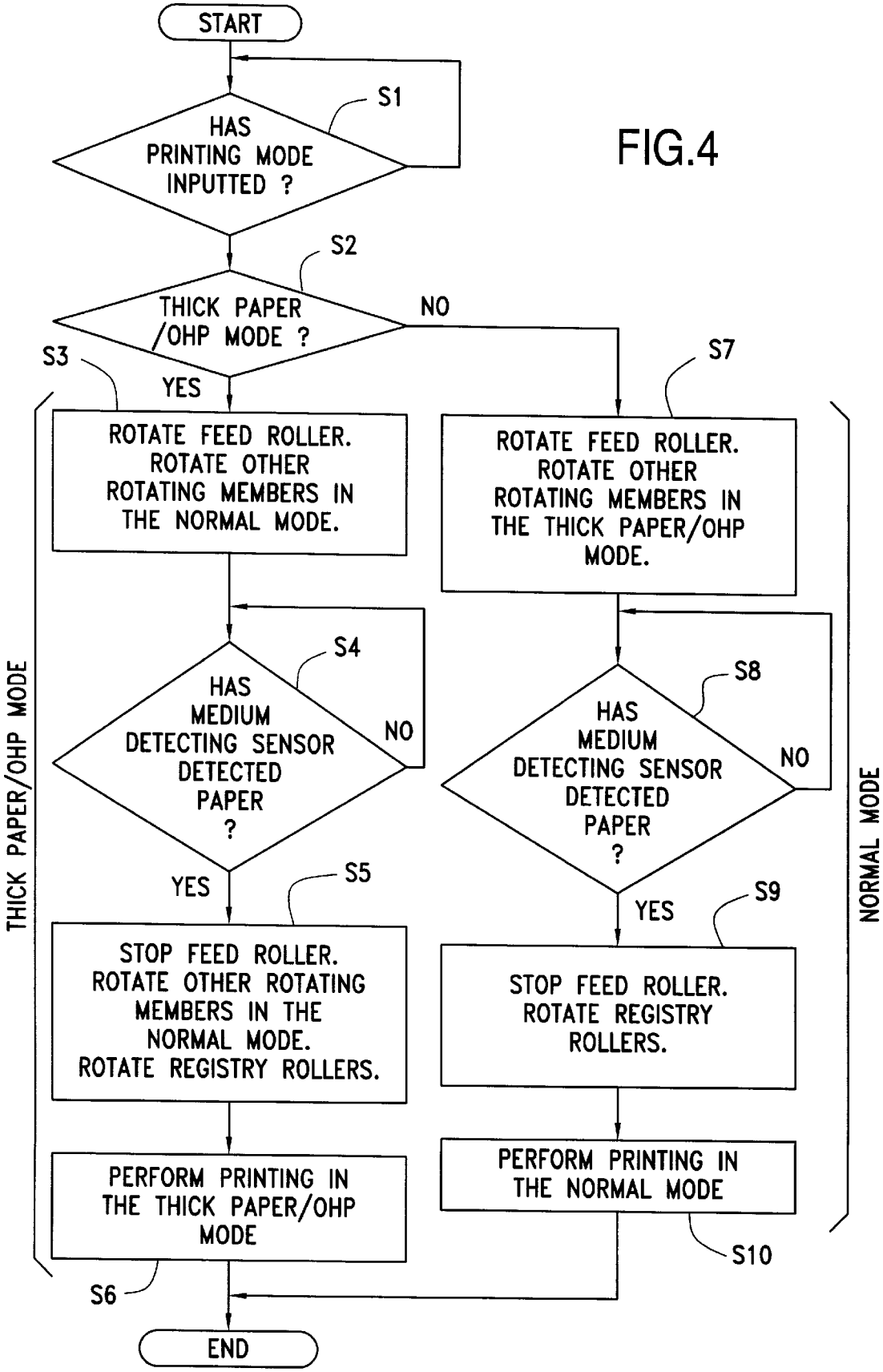
FIG. 4 is a flowchart illustrating the printing operation of the image-forming apparatus of the embodiment.

FIG. 4 is a flowchart illustrating the printing operation of the image-forming apparatus of the first embodiment.

Figure 5:
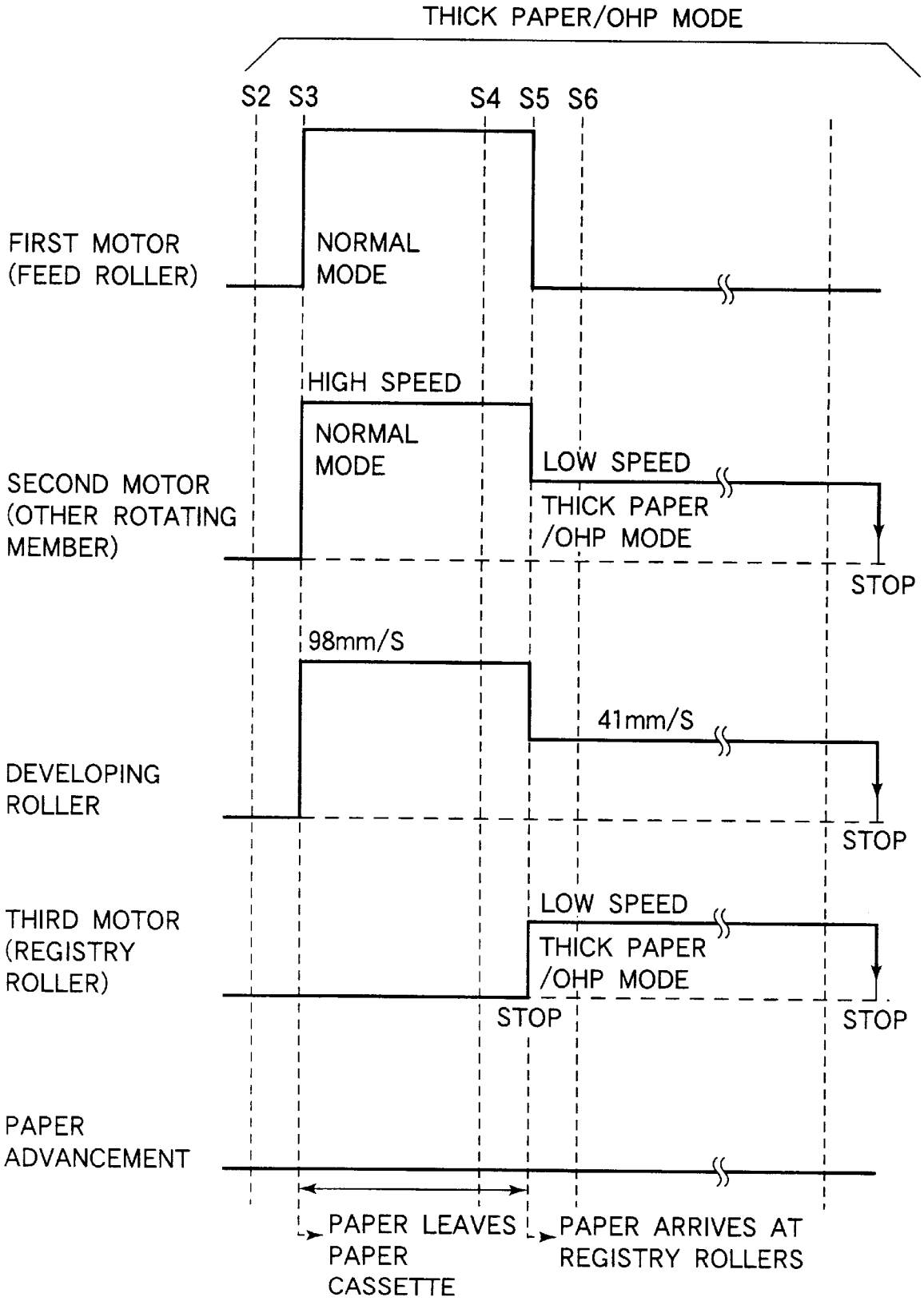
FIG. 5 is a timing chart illustrating the printing operation of the image-forming apparatus of the embodiment.

FIG. 5 is a timing chart that corresponds to the thick paper/OHP mode (S2–S6).

Figure 6:
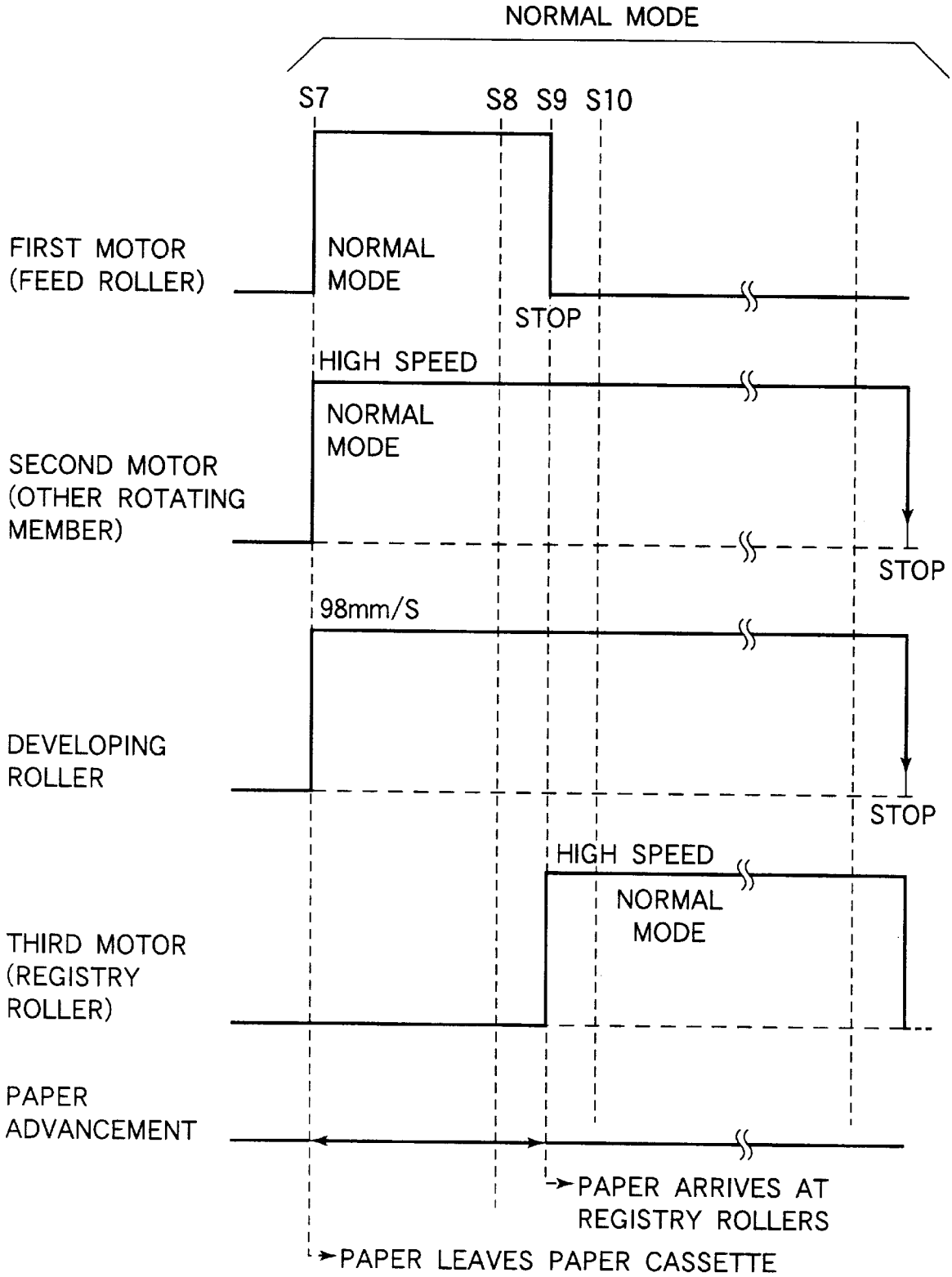
FIG. 6 is a timing chart illustrating the printing operation of the image-forming apparatus of the embodiment.

FIG. 6 is a timing chart that corresponds to the normal mode (S7–S10).

First, an operator inputs a desired printing mode through an inputting section, not shown, into the image forming apparatus. The printing performed includes two modes: a normal mode where an image is printed on ordinary paper and a thick paper/OHP mode where an image is printed on thick paper or a transparency. The respective rollers are rotated at speeds in accordance with a selected printing mode. For example, in the normal mode, the developing roller 8 rotates at a circumferential speed of 98 mm/s, which is a speed of the surface of the developing roller relative to the developing blade 12. In the thick paper/OHP mode, the developing roller 8 rotates at a circumferential speed of 41 mm/s relative to the developing blade 12. In other words, the respective rollers are rotated at lower speeds in the thick paper/OHP mode than in the normal mode. Thus, printing requires a longer fixing time in the thick paper/OHP mode than in the normal mode. In the normal mode, the printing speed is such that 12 pages of A4 size paper can be printed in one minute. In the thick paper/OHP mode, 5 pages of A4 size paper can be printed in one minute.

{Printing in Thick Paper/OHP Mode}

The printing operation in the thick paper/OHP mode will be described with reference to FIGS. 4 and 5.

Referring to FIGS. 4 and 5, at step S1, upon detecting a printing mode inputted by the operator, the controller 37 causes the image-forming apparatus 1, which has been in the standby state, to start printing. Then, the program proceeds to step S2 where the controller 37 determines whether the normal mode was specified or the thick paper/OHP mode was specified. If the thick paper/OHP mode was specified, then the program proceeds to step S3. If the normal mode was specified, the program proceeds to step S7.

At step S3, the controller 37 issues a paper-feeding instruction. In other words, the controller 37 causes the motor driver 38 to drive the first motor 41 in rotation, so that the first motor 41 causes the feed roller 24 to rotate. Thus, the feed roller 24 feeds the top page of the stack of paper 22 held in the paper cassette 23. The controller 37 controls the second motor driver 39 to drive the second motor 42 in rotation, thereby rotating the photoconductive drum 5, charging roller 7, developing roller 8, spiral screw 10, sponge roller 13, heat roller 7, pressure roller 29, and discharge rollers 31 and 32. The respective rollers including the feed roller 24 rotate at speeds in the normal mode.

As described above, during the paper-feeding operation prior to the developing operation, the circumferential speed of the developing roller 38 relative to the developing blade 12 is 98 mm/s. This speed allows the toner on the developing roller 38 to exert an increased pressure on the developing blade 12, so that the toner on the developing roller 38 pushes up the developing blade 12 to create a gap between the developing roller 38 and the developing blade 12. The toner clumps trapped in the gap are released or crushed by the developing roller 38 and the developing blade 12. In the present invention, the circumferential surface of the developing roller 8 is required to run over at least half the nip formed between the developing roller 8 and the developing blade 12, and preferably over a distance longer than one complete circumference of the developing roller 8. As a result, the toner clumps no longer remain sandwiched between the developing roller 38 and the developing blade 12. In the present embodiment, the term "paper-feeding operation" is used to cover an operation from the feeding of the top page of the paper 22 from the paper cassette until when the medium-detecting sensor 36 detects the paper 22. The term "developing operation" is used to cover an operation from the detection of the paper 22 by the medium-detecting sensor 36 until when the toner image on the paper is fused into a permanent image.

At step S4, the controller 37 determines whether the medium-detecting sensor 36 has detected the paper 22. If the controller 37 receives a signal indicating that the medium-detecting sensor has detected the paper 22, then the program proceeds to step S5 where the controller 37 controls the third motor driver 40 to drive the third motor 43 at the speed in the thick paper/OHP mode. The controller 37 also controls the second motor driver 39 to decrease the speed of the second motor 42 to the speed in the thick paper/OHP mode, thereby decreasing the speeds of the photoconductive drum 5, charging roller 7, developing roller 38, spiral screw 10, sponge roller 13, heat roller 28, pressure roller 29, and discharge rollers 31 and 32 to the speeds in the thick paper/OHP mode. At this moment, the developing roller 38 is rotating at a circumferential speed of 41 mm/s with respect to the developing blade 12. At the same time, the controller 37 controls the first motor driver 38 to stop the first motor 41, so that the feed roller 24 stops rotating as soon as the leading end of the paper 22 reaches the registry rollers 26 and 27.

The paper 22 is then transported by the registry rollers 26 and 27 to the image-forming cartridge 2. Then, the controller 37 proceeds to step S6 where printing is performed on the paper 22 that is being advanced at the speed in the thick paper/OHP mode. After the paper 22 has been discharged from the printer, the controller 37 controls the second motor driver 39 and third motor driver 40 to bring the second and third motors 42 and 43 to stops, respectively. This stops the rotation of the photoconductive drum 5, charging roller 7, developing roller 8, spiral screw 10, sponge roller 13, heat roller 28, pressure roller 29, discharge rollers 31 and 32, and registry rollers 26 and 27. Then, the control operation in the thick paper/OHP mode is completed.

{Printing in Normal Mode}

The printing operation in the normal mode will be described with reference to FIGS. 4 and 6.

If it is determined at step S2 that the normal mode is specified, the program proceeds to step S7 where the controller 37 issues the paper-feeding instruction to feed the paper 22 from the paper cassette. For this purpose, the controller 37 controls the first motor driver 38 to drive the first motor 41 in rotation which in turn causes the feed roller 24 to rotate to feed the top page of the paper 22 from the paper cassette 23. At the same time, the controller 37 causes the second motor driver 39 to drive the second motor 42 in rotation. The second motor 42 in turn causes the rotation of the photoconductive drum 5, charging roller 7, developing roller 8, spiral screw 10, sponge roller 13, heat roller 28, pressure roller 29, discharge rollers 31 and 32, and registry rollers 26 and 27. At this moment, the respective rollers including the feed roller 24 rotate at speeds in the normal mode. For example, the circumferential speed of the developing roller 8 relative to the developing blade 12 is 98 mm/s.

At step S8, the controller 37 determines whether the medium-detecting sensor 36 has detected the paper 22. If the answer is YES, then the program proceeds to step S9 where the controller 37 controls the third motor driver 40 to drive the third motor 43 in rotation, thereby causing the registry rollers 26 and 27 to rotate at the speed in the normal mode. The controller 37 also controls the first motor driver 38 to bring the first motor 41 to a stop. As a result, when the leading end of the paper 22 reaches the registry rollers 26 and 27, the feed roller 24 stops.

The paper 22 is then advanced by the registry rollers 26 and 27 to the image-forming cartridge 2. Subsequently, the controller 37 proceeds to step S10 where printing is performed on the paper 22 that is being transported at the speed in the normal mode. The printing is performed in the normal mode and the printed paper is discharged from the image-forming apparatus 1. After the paper 22 has been discharged, the controller 37 controls the second motor driver 39 and the third motor driver 40, thereby causing the second motor 42 and third motor 43 to stop. This stops the rotation of the photoconductive drum 5, charging roller 7, developing roller 8, spiral screw 10, sponge roller 13, heat roller 28, pressure roller 29, discharge rollers 31 and 32, and registry rollers 26 and 27.

In order to determine the frequency of the occurrence of white lines, printing was performed for different circumferential speeds of the developing roller 8 relative to the developing blade 12 in the range of 16 mm/s to 114 mm/s. The printing was performed on a total of 1000 pages of the paper 22.

TABLE 1

| Circumferential speed of developing roller (mm/s) | The number of occurrence of white lines | Total circumferential distance over which the developing roller passes developing blade (mm) | Occurrence of Filming |
|---|---|---|---|
| 16 | 13 | 35,151 | NO |
| 24 | 8 | 57,120 | NO |
| 33 | 6 | 76,160 | NO |
| 41 | 5 | 91,392 | NO |
| 49 | 3 | 152,320 | NO |
| 57 | 2 | 228,480 | NO |
| 65 | 1 | 456,960 | NO |
| 73 | 0 | not occur | NO |
| 81 | 0 | not occur | NO |
| 89 | 0 | not occur | NO |
| 98 | 0 | not occur | NO |
| 106 | 0 | not occur | NO |
| 114 | 0 | not occur | NO |
| 990 | 0 | not occur | NO |
| 998 | 0 | not occur | NO |
| 1007 | 0 | not occur | NO |
| 1015 | 0 | not occur | NO |
| 1023 | 0 | not occur | YES |
| 1031 | 0 | not occur | YES |
| 1039 | 0 | not occur | YES |
| 1047 | 0 | not occur | YES |

The following are the parameters used in the experiment.

The average diameter of the toner particles was in the range of 6 to 9 $\mu$m. The toner clumping was less than 30%. The developing blade 12 exerted a pressure of 900 gram-weight on the developing roller 8. The spring constant of the developing blade 12 in contact with the developing roller 8 was 675 gram/mm. The thickness of toner layer was 20 $\mu$m. The toner clumping is measured by a powder characteristic-measuring device and defined as a sum of three values given by the following three formulae (1), (2), and (3).

$$\text{weight percent of toner left on a sieve having a mesh of 150 } \mu\text{m})\times 1 \quad (1)$$

$$(\text{weight percent of toner left on a sieve having a mesh of 75 } \mu\text{m})\times 0.6 \quad (2)$$

$$(\text{weight percent of toner left on a sieve having a mesh of 45 } \mu\text{m})\times 0.2 \quad (3)$$

As is clear from Table 1, no white line will occur in a printed image if the circumferential speed of the developing roller 8 relative to the developing blade 12 is higher than 73 mm/s when the paper is fed from the paper cassette immediately before the developing operation.

Therefore, in the normal mode, the developing roller 8 is rotated at a constant speed throughout the operations, i.e., the feeding, printing, and discharging of the printed paper 22. In the normal mode and the thick paper/OHP mode, the developing roller 8 is rotated at a speed not lower than 73 mm/s during the paper feeding operation, and at a lower speed than 73 mm/s during the developing operation. Controlling the rotational speed of the developing roller 8 in this manner prevents white lines from occurring in printed images on the paper 22. Therefore, the image-forming apparatus may be designed to perform a printing operation that includes a first period (e.g., paper-feeding period) and a second period (e.g., developing period) following the first period. The developing roller 8 rotates at a first speed (e.g., 98 mm/s) during the first period, and then at a second speed (e.g., 41 mm/s) lower than the first speed during the second period.

Circumferential speeds of the developing roller 8 higher than 1015 mm/s causes toner to melt due to heat generated by friction between the developing roller 8 and the developing blade 12. In other words, melted toner is deposited on the developing roller 8 and the developing blade 12, resulting in a "filming" i.e., a toner layer of non-uniform thickness formed on the developing roller 8. Thus, the circumferential speed of the developing roller 8 should be maintained less than 1015 mm/s.

As described above, in the first embodiment, the developing roller is rotated at a circumferential speed not lower than 73 mm/s during the paper-feeding operation in the thick paper/OHP mode. Thus, the toner exerts a higher pressure on the developing blade, creating a gap between the developing roller and the developing blade so that clumped toner particles existing between them are crushed or released. In this manner, the clumped toner particles can be removed from areas between the developing roller 8 and developing blade 12 to prevent clumped toner from being present on the surface of the developing roller 8. Rotating the developing roller 8 in the aforementioned manner provides good print quality without white lines.

Alternatively, the printer may be designed such that in the thick paper/OHP mode, only the developing roller 8 runs at different speeds during the paper-feeding operation and the developing operation, and the other rollers rotate at respective constant speeds.

Although the paper-feeding operation is activated when the operator specifies a desired printing mode, the controller 37 may determine, after the paper-feeding operation has begun, whether the mode specified by the operator is the normal mode or the thick paper/OHP mode.

Second Embodiment

A total or cumulative circumferential distance over which the surface of the developing roller 8 passes the edge of developing blade 12 is determined on the basis of the circumferential speed and radius of the developing roller 8. The higher the circumferential speed, the longer the distance that the circumferential surface of the developing roller 8 travels before white lines appear in the print result. The cumulative circumferential distance is cumulative through successive printing operations. Referring to Table 1, for example, when the circumferential speed of the developing roller 8 is 41 mm/s, five white lines occurred. Shortly after the surface of the developing roller 8 had traveled over a distance of 91,392 mm, the first one of the five white lines occurred.

In other words, the occurrence of white lines may be predicted by experimentally measuring the total or cumulative circumferential distance over which the surface of the developing roller 8 travels before white lines actually occur. On the basis of the experimental results, the circumferential speed of the developing roller 8 may be increased before white lines occur, thereby preventing occurrence of white lines.

Thus, in the thick paper/OHP mode, the developing roller 8 may be programmed to rotate at the same speed throughout the printing operation of each page, instead of at different speeds for the paper-feeding period and developing period. In other words, every time the surface of the developing roller 8 has traveled over a predetermined cumulative distance, the developing roller 8 may be rotated at an increased speed over a certain circumferential distance of the developing roller 8. In this case, the controller 37 monitors the total or cumulative distance over which the surface of the developing roller 8 travels relative to the developing blade 12 while printing. This cumulative distance is selected to be a minimum value equal to a length of a page of print paper and a maximum value 456,960 mm.

When the predetermined cumulative distance reaches, for example, 91,392 mm, the developing roller 8 is then controlled to rotate at an increased speed higher than 73 mm/s over a predetermined short distance. If the predetermined cumulative distance is reached when a printing operation is being performed, the printing operation may be interrupted at a proper timing and then the developing roller 8 is controlled to rotate at an increased speed higher than 73 mm/s. After the surface developing roller 8 has traveled over the predetermined short distance at the increased speed, the printing operation is resumed. The predetermined short distance should be at least half (e.g., 1 mm) the circumferential distance over which the developing roller is in contact with the developing blade 12, and preferably longer than the one complete circumference of the developing roller 8. Alternatively, the developing roller 8 may be rotated over the predetermined short distance during the paper-feeding operation of a printing operation.

Figure 7:
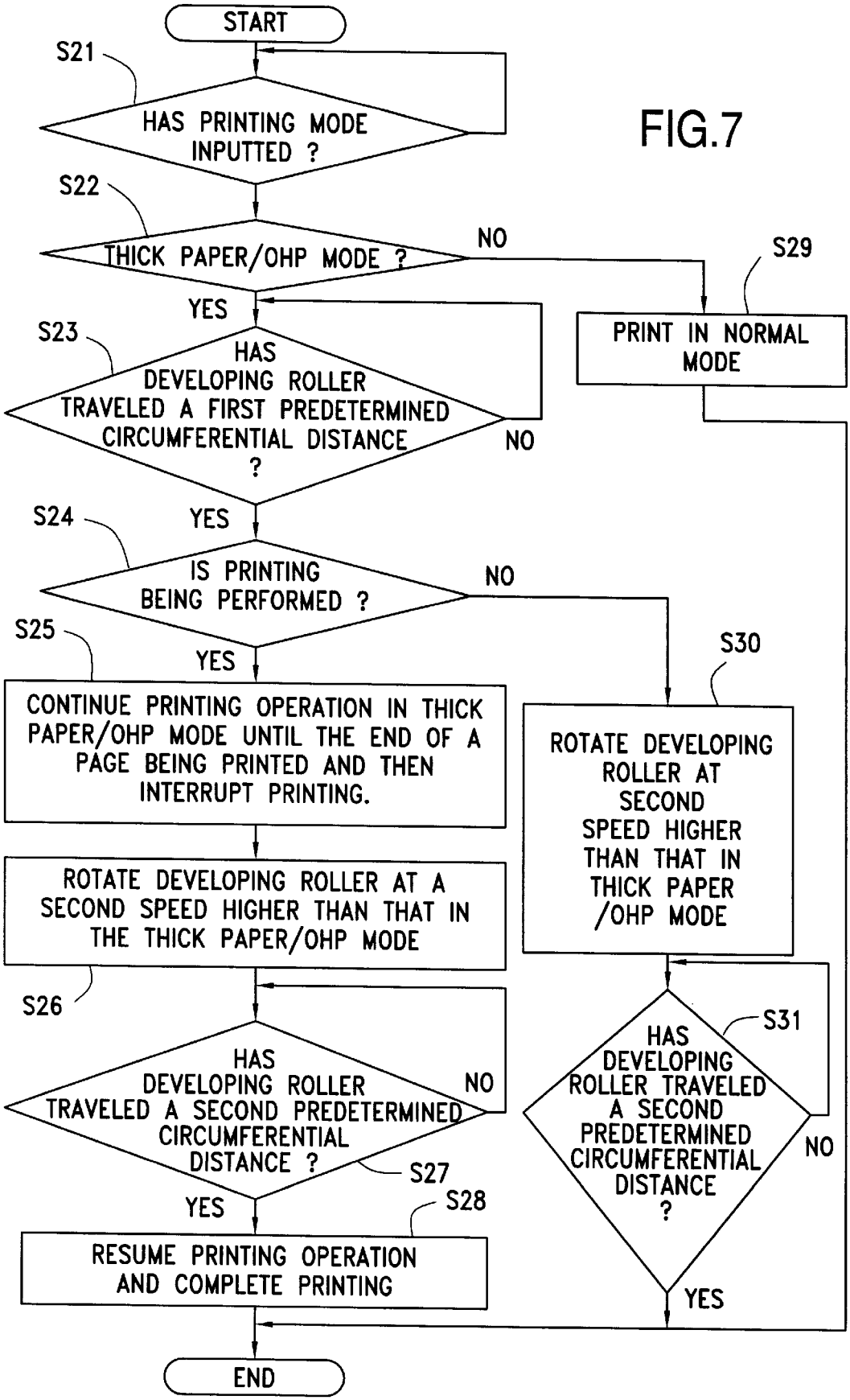
FIG. 7 is a flowchart that corresponds to the thick paper/OHP mode.

FIG. 7 is a flowchart that corresponds to the thick paper/OHP mode.

Figure 8:
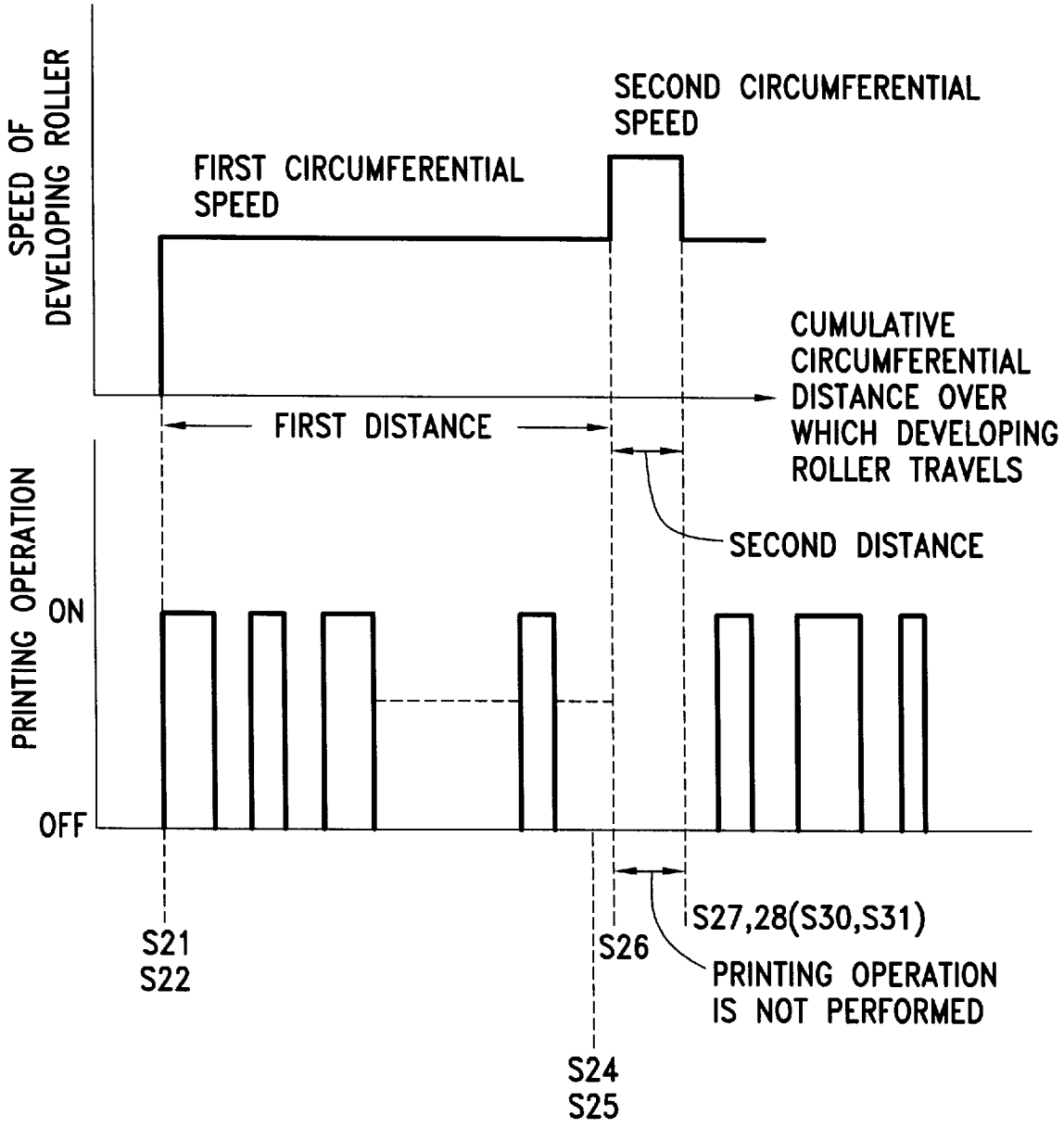
FIG. 8 is a timing chart that corresponds to the flowchart in FIG. 5.

FIG. 8 is a timing chart that corresponds to the flowchart in FIG. 5.

Referring to FIGS. 7 and 8, at step S21, upon detecting a printing mode inputted by the operator, the controller 37 causes the image-forming apparatus 1, which has been in the standby state, to start printing. Then, the program proceeds to step S22 where the controller 37 determines whether the normal mode was specified or the thick paper/OHP mode was specified. If the thick paper/OHP mode was specified, then the program proceeds to step S23. If the normal mode was specified, the program proceeds to step S29.

At step S24, a check is made to determine whether printing is being performed. If the answer is YES, then the program proceeds to step S25 where printing is continued in the thick paper/OHP mode until the end of a page being printed and then printing is interrupted. Then, the program proceeds to step S26 where the developing roller is rotated at a speed (i.e., second circumferential speed) higher than that (i.e., first circumferential speed) in the thick paper/OHP mode. Then, the program proceeds to step S27 where a check is made to determine whether the circumferential surface of the developing roller has traveled a predetermined circumferential distance. If the answer is YES at step S27, then the program proceeds to step S28 where printing is resumed and continued until the print job is completed.

If the answer is NO at step S24, the program proceeds to S30 where the developing roller is rotated at a speed (i.e., second circumferential speed) higher than that (i.e., first circumferential speed) in the thick paper/OHP mode. Then, the program proceeds to step S31 where a check is made to determine whether the circumferential surface of the developing roller has traveled a predetermined circumferential distance. If the answer is YES at step S27, then the program ends and the printer waits for the next print job.

If the answer is NO at step S22, then the program proceeds to step S29 where printing is performed in the normal mode.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image-forming apparatus comprising:

a developing member, rotating in contact with a photoconductor to deposit toner to an electrostatic latent image formed on the photoconductor; and a toner applying member, applying toner to said developing member, said toner applying member forming a thin layer of toner on said developing member;

wherein the image-forming apparatus performs a printing operation that includes a first period and a second period following the first period, and said developing member rotates relative to said toner applying member at a first circumferential speed during the first period and then at a second circumferential speed lower than the first circumferential speed during the second period.

2. The image-forming apparatus according to claim 1, wherein the first period is a length of time during which a print medium is fed to a predetermined position from a medium-holding cassette, wherein the second period is a length of time during which the toner is deposited to the electrostatic latent image.

3. The image-forming apparatus according to claim 1, wherein the first circumferential speed is between 73 mm/s and 1015 mm/s.

4. The image-forming apparatus according to claim 1, wherein the second circumferential speed is lower than 73 mm/s.

5. An image-forming apparatus comprising:

a developing member, rotating in contact with a photoconductor to deposit toner to an electrostatic latent image formed on the photoconductor; and a toner applying member, applying toner to said developing member, said toner applying member forming a thin layer of toner on said developing member;

wherein said developing member rotates relative to said toner applying member at a first circumferential speed until a surface of said developing member has traveled over a first cumulative circumferential distance with respect to said toner applying member; and wherein if the surface has traveled over the first cumulative circumferential distance, then said developing member rotates relative to said toner applying member at a second circumferential speed over a second circumferential distance after a developing operation of a page of medium, the second circumferential speed being higher than the first circumferential speed.

6. The image-forming apparatus according to claim 5, wherein the first circumferential distance is shorter than a distance such that print quality begins to be deteriorated.

7. The image-forming apparatus according to claim 5, wherein the first circumferential speed is lower than 73 mm/s.

8. The image-forming apparatus according to claim 5, wherein the second circumferential speed is between 73 mm/s and 1015 mm/s.

9. The image-forming apparatus according to claim 5, wherein the second circumferential distance is longer than half a nip formed between said developing member and said toner applying member.

10. The image-forming apparatus according to claim 5, wherein the first cumulative circumferential distance is less than 456,960 mm.

11. The image-forming apparatus according to claim 5, wherein after said developing member has rotated at the second circumferential speed over the second circumferential distance, said developing member rotates at the first circumferential speed with respect to said toner applying member to perform another developing operation.

12. The image-forming apparatus according to claim 5, wherein after the image-forming apparatus becomes ready to the developing operation at the first circumferential speed, a counting operation is initiated to count a cumulative circumferential distance over which said developing member rotates at the first circumferential speed.

13. The image-forming apparatus according to claim 5, wherein when the developing operation is carried out on a predetermined medium, said developing member rotates at the first circumferential speed.

14. An image-forming apparatus comprising:

a developing member, rotating to deposit toner to an electrostatic latent image formed on a photoconductor; and a toner applying member, applying toner to said developing member in pressure contact with said developing member to form a thin layer of toner on said developing member;

wherein when a developing operation is not being carried out on a print medium, said developing member rotates over a first circumferential distance at a at a first circumferential speed; and wherein when the developing operation is being carried out on the print medium, said developing member rotates at a second circumferential speed lower than the first circumferential speed.

15. The image-forming apparatus according to claim 14, wherein the print medium undergoes an operation before it undergoes the developing operation.

16. The image-forming apparatus according to claim 15, wherein the operation before the medium undergoes the developing operation is a medium-feeding operation operation.

17. The image-forming apparatus according to claim 14, wherein the print medium undergoes a first operation and then a second operation which is a developing operation.

18. The image-forming apparatus according to claim 17, wherein the first operation is a medium-feeding operation operation.

19. The image-forming apparatus according to claim 14, wherein the first circumferential distance is at least half a nip formed between said developing member and said toner applying member.

20. The image-forming apparatus according to claim 14, wherein when the developing operation is carried out on a predetermined medium to form a permanent image on the medium, said developing member rotates at the second circumferential speed.

* * * * *